US006892857B2

(12) United States Patent
Baker

(10) Patent No.: US 6,892,857 B2
(45) Date of Patent: May 17, 2005

(54) FIRE ESCAPE

(75) Inventor: Ralph T. Baker, Earleville, MD (US)

(73) Assignee: Baker Safety Equipment, Inc., Townsend, DE (US)

( * ) Notice: Subject to any disclaimer, the term of this patent is extended or adjusted under 35 U.S.C. 154(b) by 0 days.

(21) Appl. No.: 10/721,570

(22) Filed: Nov. 25, 2003

(65) Prior Publication Data

US 2004/0104072 A1 Jun. 3, 2004

Related U.S. Application Data

(63) Continuation of application No. 10/163,716, filed on Jun. 6, 2002, now abandoned.

(51) Int. Cl.[7] ..... A62B 1/20
(52) U.S. Cl. ..... 182/48; 182/49; 182/138
(58) Field of Search ..... 182/48, 49, 70, 182/138; 193/25 R

(56) References Cited

U.S. PATENT DOCUMENTS

| | | | | |
|---|---|---|---|---|
| 208,944 A | | 10/1878 | Wohlmann | |
| 217,142 A | | 7/1879 | Pfefferie | |
| 263,952 A | | 9/1882 | Penn | |
| 293,707 A | | 2/1884 | Bradley | |
| 418,879 A | | 1/1890 | Anidjah | |
| 672,623 A | | 4/1901 | Jennings | |
| 908,034 A | | 12/1908 | Pyleck | |
| 952,315 A | | 3/1910 | Erwin et al. | |
| 3,763,497 A | | 10/1973 | Leach | |
| 4,099,596 A | | 7/1978 | Tracy | |
| 4,123,830 A | | 11/1978 | Matsuda et al. | |
| 4,154,320 A | | 5/1979 | Jatczak | |
| 4,252,214 A | * | 2/1981 | Miller | 182/8 |
| 4,442,918 A | * | 4/1984 | Rhoads, Sr. | 182/10 |
| 4,458,781 A | * | 7/1984 | Ellis et al. | 182/5 |
| 4,582,166 A | | 4/1986 | Baker | |
| 4,595,074 A | | 6/1986 | Nordtvedt | |
| 4,778,031 A | | 10/1988 | Curiel | |
| 4,826,155 A | | 5/1989 | James | |
| 5,806,624 A | | 9/1998 | Nordtvedt | |
| 6,098,747 A | | 8/2000 | Reece | |
| 6,467,575 B1 | | 10/2002 | Chen | |
| 6,601,829 B2 | * | 8/2003 | Graham | 254/391 |

FOREIGN PATENT DOCUMENTS

| | | |
|---|---|---|
| GB | 2232138 | 12/1990 |

* cited by examiner

*Primary Examiner*—Bruce A. Lev
(74) *Attorney, Agent, or Firm*—E. Alan Uebler, PA

(57) ABSTRACT

Fire escape apparatus for egress from a multi-storied building structure from an upper level thereof is provided. The apparatus includes an elongate mesh tube, the tube being substantially longer than the structure height from which escape is required, and sufficiently long to enable extension of the tube downwardly to the ground. The building structure has permanently attached thereto a guide wire or cable extending at a desired angle from the upper level to the ground. The elongate mesh tube has affixed thereto, at spaced-apart intervals along its length, a plurality of supporting blocks-and-pulleys engaging the guide wire or cable. When escape is required, the mesh tube is deployed from the upper level to the ground, riding upon the pulleys, thereby permitting escape to ground level through the tube by persons entering the tube from the upper level.

30 Claims, 6 Drawing Sheets

FIRE ESCAPE

CROSS REFERENCE TO RELATED APPLICATION

This application is a continuation application of U.S. patent application Ser. No. 10/163,716, filed Jun. 6, 2002 now abandoned titled IMPROVED FIRE ESCAPE.

BACKGROUND OF THE INVENTION

This invention relates to fire escapes for use in evacuating, quickly, a multiple story building such as, for example, where fire threatens the occupants of the building.

Conventional fire escapes have disadvantages. They are generally finite in number, e.g. one or two per floor in a given building, if provided at all, and fixed in place so that, if smoke and flames approach a lower part of such fire escape, it becomes useless to persons on floors above the lower part.

Many prior art devices are known which relate to chutes or tubes for use in escaping high-rise buildings in the event of a fire. Exemplary of such devices are those shown in U.S. Pat. No. 4,240,520 (1980) and U.S. Pat. No. 4,099,596 (1978).

U.S. Pat. No. 4,240,520 discloses a fire escape tunnel for use in exiting high-rise buildings. The tunnel includes an extendable, accordion-pleated tubing made of nylon or canvas fabric padded on its inner side, a ring at its upper end attachable to an escape opening of a building, a lower end of the tubing having a soft landing pad, and an exit doorway so a person sliding or being lowered down the tunnel can step out onto the ground at the exit.

U.S. Pat. No. 4,099,596 discloses a device including a normally-folded flexible tube with a landing pad at its lower end that unfolds to a vertical chute condition, the interior of the tube being slippery to provide against snagging and the like, the unfolded tube being formed with elastic restrictions at successive vertical levels that snub the descent of a person descending inside from free fall to an alleged safe speed.

My prior U.S. Pat. Nos. 4,398,621; 4,580,659; 4,582,166 and 4,583,616 all disclose fire escapes and variations thereof which employ an elongated mesh tube or chute through which a person escaping a burning building may descend, from the upper floors of the building to safety on the ground. The escape chute of the present invention embodies many of the basic principles and components disclosed in my prior patents, and the disclosures in those patents are incorporated herein by reference thereto.

U.S. Pat. No. 3,580,358 discloses a safety escape chute having a series of pliant tubular columns connected by resilient portions made of spiral mesh so that when a first escaper is in the chute his weight so deforms the spiral mesh resilient portions downwardly that a second escaper cannot pass therethrough and thus cannot collide with the first escaper at the bottom of the chute.

Escape tubes utilized in combination with an angularly disposed cable are known such as, for example, in my prior patent U.S. Pat. No. 4,582,166 and the apparatus disclosed in U.S. Pat. No. 4,339,019.

The present invention overcomes many disadvantages inherent in prior art devices.

SUMMARY OF THE INVENTION

Fire escape apparatus for egress from a multi-storied building structure from an upper level thereof is provided.

The apparatus includes an upper, supporting entry ring member detachably anchored to the structure at an exit location such as on the roof. The entry ring member has attached to it one end of an elongate mesh tube, the mesh tube being substantially longer than the structure height from which escape is required, and sufficiently long to enable extension of the tube downwardly from the exit location to the ground. The mesh tube has a lower, exit-opening support ring member attached thereto at its other end. The building structure has permanently attached thereto, adjacent the upper exit location, one end of a guide wire or cable extending from this upper location on the structure at a desired angle to the ground. The cable is permanently affixed at its other end to a ground anchor on the ground. The elongate mesh tube has affixed thereto, at spaced-apart intervals along a length of the tube, a plurality of supporting block-and-pulley means, the pulleys of each block-and-pulley means engaging and riding upon the guide wire or cable. When needed, the tube is deployed from the upper level exit location downwardly such that the exit-opening ring member extends to ground level and the entry ring member affords entry therethrough into the tube at the upper exit location of the building, thereby permitting escape to ground level through said tube by a person entering the tube from the upper level. Usually the exit location will be the roof of the building structure, but the principles of the invention are adaptable to other upper level openings in a building structure, including a window thereof.

The plurality of block-and-pulley means may be spaced apart at equal intervals along a length of the guide wire, upon deployment of the escape apparatus, and preferably are spaced apart along the entire length of the guide wire. The block-and-pulley means are each spaced apart one-from-another at a distance preferably within the range of five feet to seven feet, most preferably at approximately six foot intervals. The guide wire or cable is preferably constructed of stainless steel and forms an angle to the ground which is between 30° and 90°, preferably being approximately 45°, dependent somewhat on space availability.

The block-and-pulley means each preferably comprise a block and dual pulleys. A sleeve may cover at least a portion of the mesh tube and extend from the entry ring member downwardly a distance from the entry ring member, preferably extending a distance of at least sixty feet downwardly from the entry ring member along the length of the tube. The sleeve is preferably constructed of Nomex® synthetic fabric.

The apparatus may include a canopy disposed over the upper portion thereof, which canopy may be retractably disposed over the apparatus. The canopy may be constructed of Kevlar® fabric. The apparatus may also include at least one longitudinal reinforcing cord affixed at one end thereof to the entry ring member, intertwining the mesh tube along its length thereof, and being affixed at its other end to the exit-opening, support ring.

The mesh tube is preferably constructed of cords intertwined to form a square mesh. At least two cords of the mesh tube preferably connect the tube and the longitudinal reinforcing cord through each supporting block of the block-and-pulley means at each point of connection with the tube, to enhance the strength and safety of each connection. The openings in the mesh tube are large enough to permit finger insertion therein but small enough to prevent foot insertion therethrough. The square openings in the preferred mesh tube have a side dimension of about two inches. The tube has inside diameter sufficiently large so as not to restrict passage of a person escaping therethrough, whereby an escaping person can control his rate of descent by pushing outwardly with his feet and/or by grasping the mesh anywhere within the tube. The mesh tube preferably has an inside diameter in the range of about 3 feet to about 4 feet.

The cords of the mesh tube are of a fire resistant material such as fire resistant nylon.

BRIEF DESCRIPTION OF THE DRAWINGS

In the accompanying drawings.

DETAILED DESCRIPTION OF THE INVENTION AND PREFERRED EMBODIMENTS WITH REFERENCE TO THE DRAWINGS

Fire escape apparatus for egress from a multi-storied building structure from an upper level thereof is provided. The apparatus includes an upper, supporting entry ring member detachably anchored to the structure at an exit location such as on the roof. The entry ring member has attached to it one end of an elongate mesh tube, the mesh tube being substantially longer than the structure height from which escape is required, and sufficiently long to enable extension of the tube downwardly from the exit location to the ground. The mesh tube has a lower, exit-opening support ring member attached thereto at its other end. The building structure has permanently attached thereto, adjacent the upper exit location, one end of a guide wire or cable extending from this upper location on the structure at a desired angle to the ground. The elongate mesh tube has affixed thereto, at spaced-apart intervals along its length, a plurality of supporting blocks-and-pulleys engaging and riding upon the guide wire or cable. When escape is required, the mesh tube is deployed from the upper level exit location downwardly such that the exit-opening ring member extends to ground level and the entry ring member affords entry therethrough into the tube at the upper exit location of the building, thereby permitting escape to ground level through said tube by persons entering the tube from the upper level. Each block-and-pulley means preferably includes a block and dual pulleys. The mesh tube is preferably constructed of cords intertwined to form a square mesh, and the openings in the mesh tube are large enough to permit finger insertion therein but small enough to prevent foot insertion therethrough. The cords of the mesh tube are of a fire resistant material such as fire resistant nylon.

Figure 1:
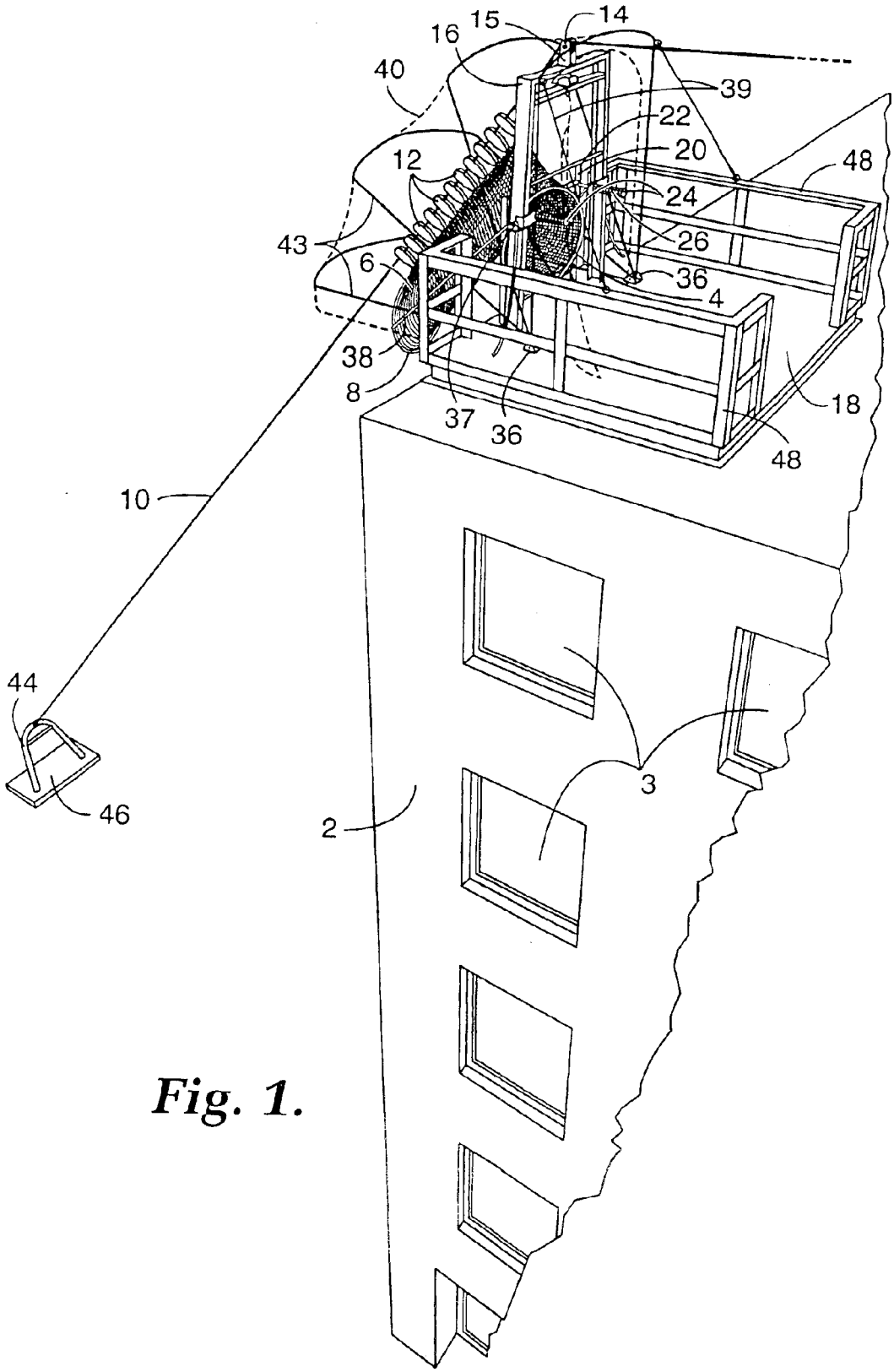
FIG. 1 depicts, in perspective, the fire escape apparatus according to this invention just prior to its deployment from the roof of a multi-storied building.

A detailed description of the invention and preferred embodiments is best provided with reference to the accompanying drawings, wherein FIG. 1 is an overall perspective view of the fire escape of the invention installed on the roof of building 2 prior to deployment thereof. The apparatus is installed on building 2, having windows 3, within optional safety railings 48, on platform 18. The essential components include the mesh tube 6 having upper support ring 4 affixed to the tube 6 at its upper end, and having lower, exit support ring 8 affixed to tube 6 at its other end. The truncated "A"-frame 16, preferably bolted to platform 18, supports the entire apparatus at its entry location on the roof of building 2. The ring 4 is larger in diameter than the supporting framework 20 which is affixed to the platform 18 as shown and to the "A"-frame 16 by means of shock absorber mounts 28 and shock absorbers 24 having shock absorbing springs 26, all of which provide some "give" to the system upon entry of a person through ring 4 and into mesh tube or chute 6. The cross-bar 22 is provided as a grab bar for the convenience of the person entering ring 4.

The escape apparatus, including upper ring 4, mesh tube 6 and lower ring 8, is affixed to guide wire or cable 10 by means of the plurality of blocks-and-pulleys 12, each of which rides along the cable 10 and each of which is affixed through the mesh of mesh tube 6 and the reinforcing cord 7. The block-and-pulley means are described in detail below.

The guide wire or cable 10 extends downwardly from the upper exit location on building 2 to the ground anchor 44 permanently affixed to the ground on ground anchor platform 46. The cable 10 is permanently affixed to the building 2 at the upper exit level (roof) by any convenient means (not shown). This cable 10 rides over pinion fulcrum 14 as shown, and assists in the support and stabilization of the entire apparatus.

Optionally, a canopy 40 is installed, which provides protection against the elements when the apparatus is in the stored configuration and also provides an opaque shield encircling the upper entry portion of the apparatus when in use. This canopy 40, shown in phantom in FIG. 1, is supported over the pivoting strut framework depicted in FIG. 1, having rotatable struts 43, all pivoting about pivot brackets 36. The support struts 43 with canopy 40 are secured and stabilized by means of support cords or wires 39, affixed to railings 48 as shown. The canopy 40 can be opened from its storage configuration, for inspection, etc., acting under the force of gravity.

Generally the fire escape apparatus of the invention will be useful for egress from building 2 in the event of an emergency requiring escape, such as a fire. The apparatus is useful for escaping from multi-storied buildings, oil rigs, airport control towers and other, similar structures.

Figure 2:
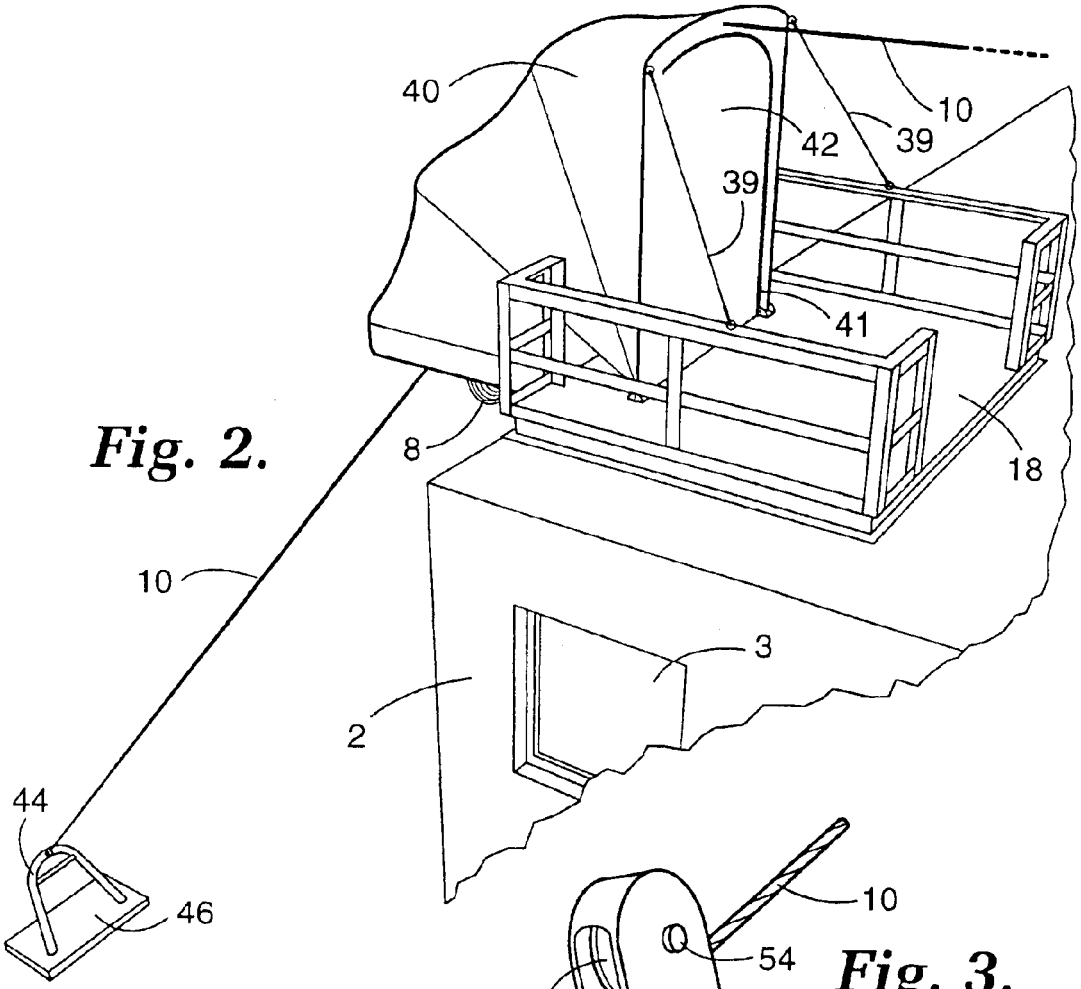
FIG. 2 is a perspective view of the escape apparatus prior to deployment and having a protective canopy thereover at its upper, entry end thereof.

FIG. 2 depicts the apparatus of the invention, also in its undeployed state, wherein canopy 40 having zippered (41) entry panel 42 is seen covering the escape chute, wherein lower ring 8 is seen exposed below the canopy, the chute itself supported and guided by cable 10. Cable 10 is anchored at one end by ground anchor 44 affixed to ground anchor platform 46 and at its other end by affixing to the building 2 at an upper anchor thereof (not shown). Cords 39 secure and stabilize the canopy and its support frame, and the apparatus is mounted on platform 18 upon the roof of building 2.

Figure 3:
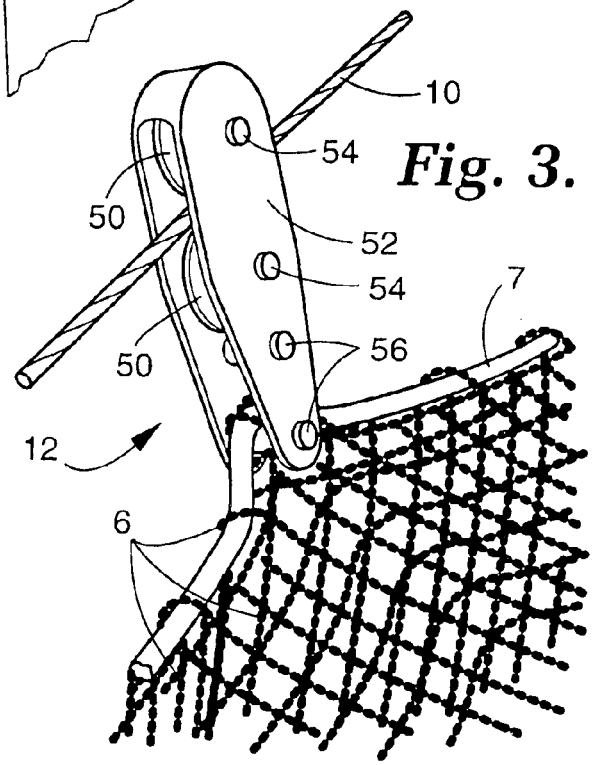
FIG. 3 shows one block-and-pulley assembly guided by and riding upon the guide cable and affixed to and supporting the mesh tube of the escape apparatus.

The escape chute having mesh tube 6 and upper support ring 4 and lower exit ring 8 is supported on guide cable 10 by the several block-and-pulley means 12 shown in FIG. 1. One embodiment of such block-and-pulley 12 is shown in FIG. 3 supporting the mesh tube 6, wherein the mesh is affixed to the block 52 by running the pin 56 of the block through the mesh of tube 6, as shown also enveloping the longitudinal reinforcing cord 7 which extends along the entire length of tube 6. Preferably pin 56 engages at least two cords of the mesh tube 6 and the reinforcing cord 7 as shown, for improved strength of the connection and for improved safety. The lower pin 56 inhibits the mesh tube 6 from tangling into the lower pulley 50 of the block-and-pulley means 12.

Figure 4:
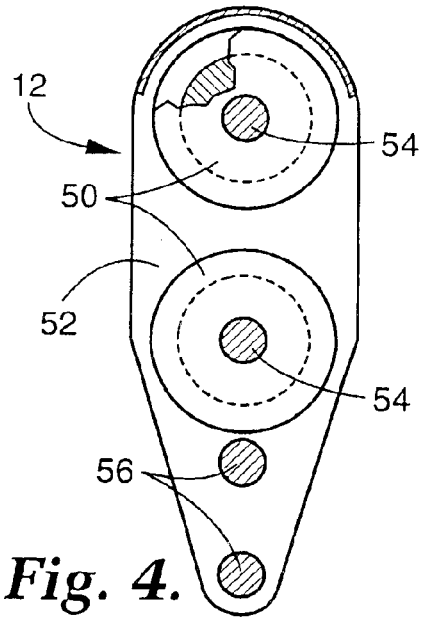
FIG. 4 is a side elevation, partly broken away, of one preferred block-and-pulley assembly used in the apparatus of the invention.

Preferably a dual pulley block-and-pulley apparatus 12, as depicted in FIGS. 3 and 4, is employed, to minimize the likelihood of tangling and obstruction of the apparatus as it is deployed downwardly along guide wire 10, all to be described in detail below. The block-and-pulley 12 shown in FIG. 3 has block 52 encasing upper and lower pulleys 50, rotatably mounted on axle pins 54 and supported by guide wire 10 which runs between the pulleys 50 as shown. In side elevation, the block-and-pulley 12 is shown in FIG. 4, including block 52, upper and lower pulleys 50 rotating around axle pins 54, and including supporting pins 56.

Figures 5, 6:
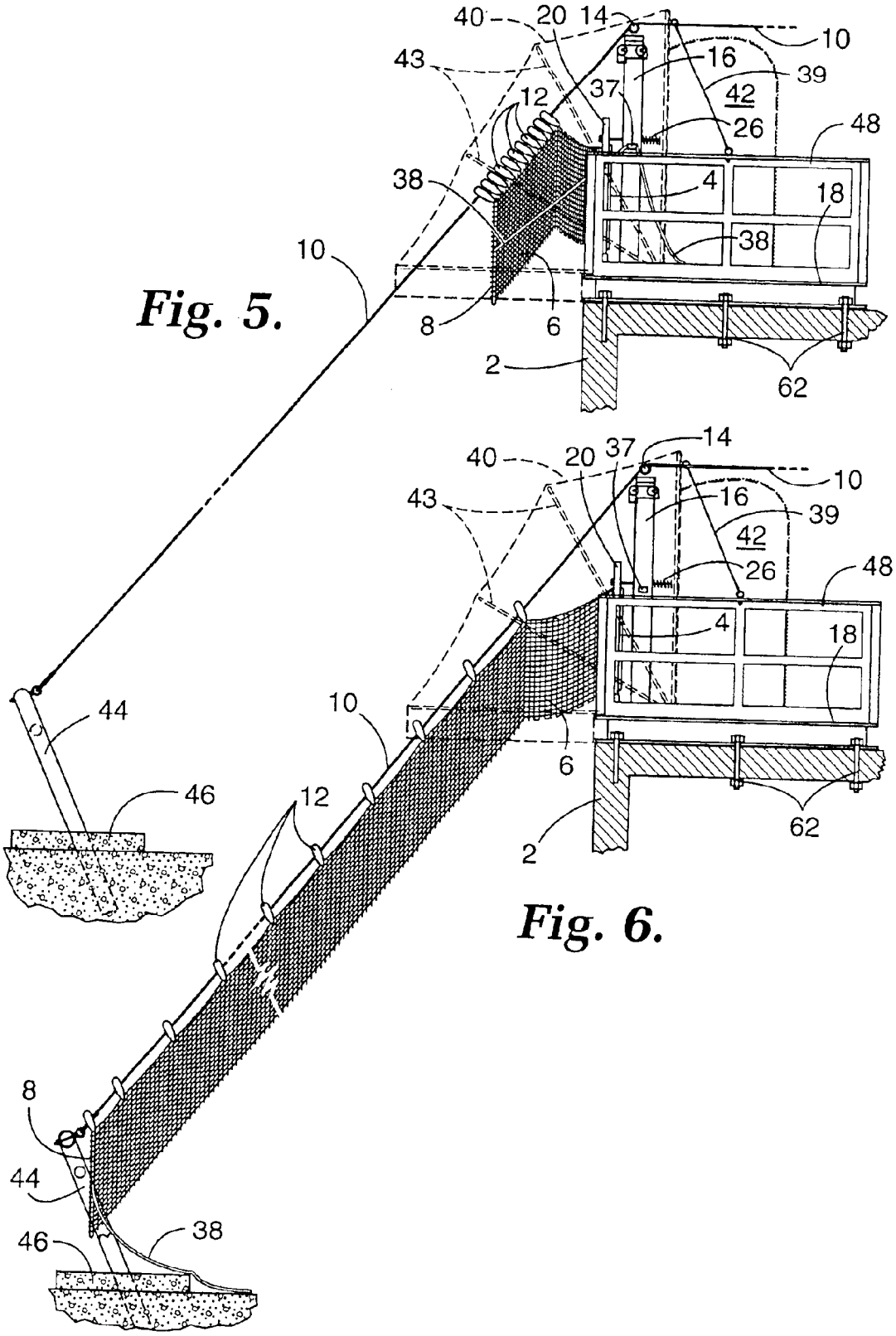
FIG. 5 is a side schematic illustration, in elevation, of the fire escape apparatus prior to deployment.
FIG. 6 depicts, in side elevation, the escape apparatus in its fully deployed mode.

FIG. 5 shows a side elevation, partly in cross-section, of one embodiment of the fire escape apparatus of the invention just prior to deployment. In FIG. 5, installed upon the roof of building 2, on a platform 18 secured to the roof by means of welding or by bolts 62 and having protective railings 48, is the escape apparatus. The escape apparatus includes elongate mesh tube 6, which is substantially longer than the height from which escape is to be effected. The tube 6 has entry support ring 4 secured to it at the upper end thereof and exit ring 8 secured to tube 6 at its lower end thereof. A plurality of block-and-pulley guide means 12 is affixed to tube 6 (and reinforcing cord 7) along its upper length at spaced-apart intervals. The pulleys 50 of the block-and-pulley guide means 12 ride on and are supported by guide wire or cable 10, as shown, which cable extends from an upper anchor on the building 2 at one end of cable 10, over fulcrum 14, and then downwardly to the ground, being anchored thereat to ground anchor 44 permanently affixed to platform 46 on the ground. The upper ring 4 is secured at the upper exit location (roof) by support frame 20 affixed to truncated "A"-frame 16 which is affixed to the platform 18. A canopy 40 (shown in phantom) is supported by pivoting canopy support frame members 43, and the canopy is shown covering the entire upper portion of the escape apparatus. In FIG. 5, the zippered door (42) of the canopy is shown open, just prior to deployment of the mesh tube 6. Cords 38, which releasably secure the chute mechanism, are secured by clam cleats 37 affixed to the truncated "A"-frame 16. To deploy the chute 6, one releases the cords 38 from their respective quick-release clam cleats 37, and the tube 6 with lower exit support ring 8 descends downwardly by the action of gravity and supported by the block-and-pulley means at spaced intervals along the tube length, as shown in detail in FIG. 6.

FIG. 6 depicts the fire escape apparatus in its fully deployed configuration. Therein, as shown, cords 38 have been released from their respective clam cleats 37 and mesh tube 6 with attached exit ring 8 has descended downwardly along cable 10, secured thereto by the plurality of block-and-pulley means 12 secured to the chute 6 at specified spacing distances. Preferably the space between these block-and-pulley fasteners is about six feet, but spacings in the range of about 5–7 feet are acceptable. The exit ring 8 deploys downwardly all the way to the ground support 44 mounted on support platform 46, where it may be secured by ground personnel, although this is not absolutely required for effective use of this fire escape. Canopy 40 remains in place as described above.

Once the chute 6 is deployed, persons may egress building 2 from the upper exit location, the roof in FIG. 6, by entering the support ring 4 and sliding through the chute 6 to the ground and, thus, escaping the building.

Figures 7, 8:
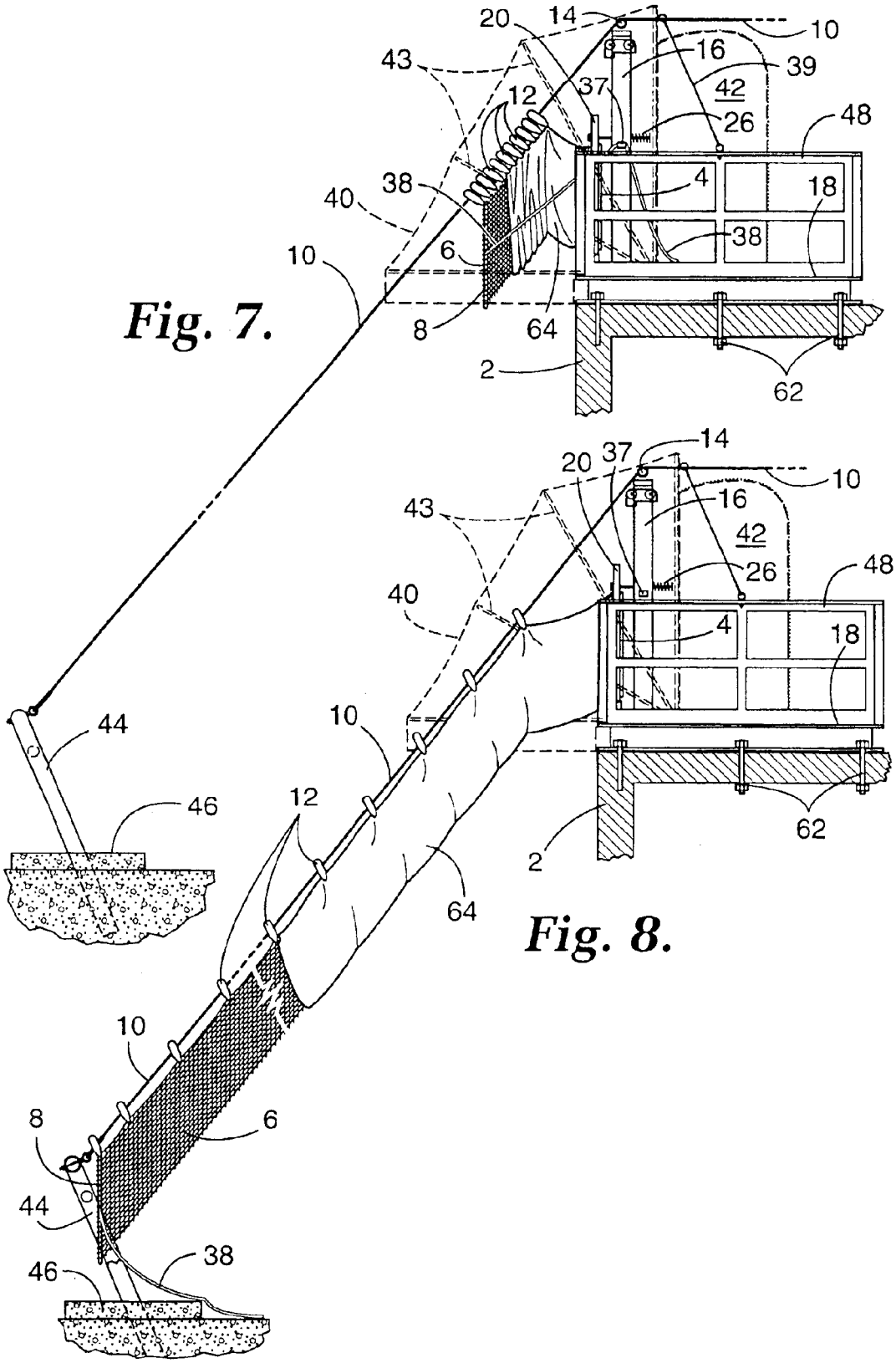
FIG. 7 is a schematic side elevation of the escape apparatus prior to deployment and having an upper, opaque sleeve encircling an upper portion of the mesh tube.
FIG. 8 shows a side elevation of the deployed apparatus with the sleeve covering the upper portion of the escape tube.

A preferred embodiment is shown in FIG. 7 wherein an opaque sleeve 64 is shown covering the mesh tube 6 over at least a portion of the tube 6 from the entry thereof at ring 4 and extending along the length of the tube. This sleeve 64 is made of a fire resistant material such as Nomex® fabric.

Referring to FIG. 7, to effect escape a person on the roof of building 2 simply pulls cords 38, releasing them from their respective cleats 37, thereby permitting the chute assembly to deploy downwardly along cable 10, the deployed configuration being shown in FIG. 8. The sleeve 64, which is affixed at the upper end to the ring 4, covers the mesh tube a distance at least part way down, as shown in FIG. 8. For tall structures, the length of the sleeve 64 is preferably about 60 feet. This opaque sleeve prevents a person using the escape from contact with flames and from seeing through the mesh upon entry into the escape, and thereby may help prevent certain anxiety associated with the escape process.

Figure 9:
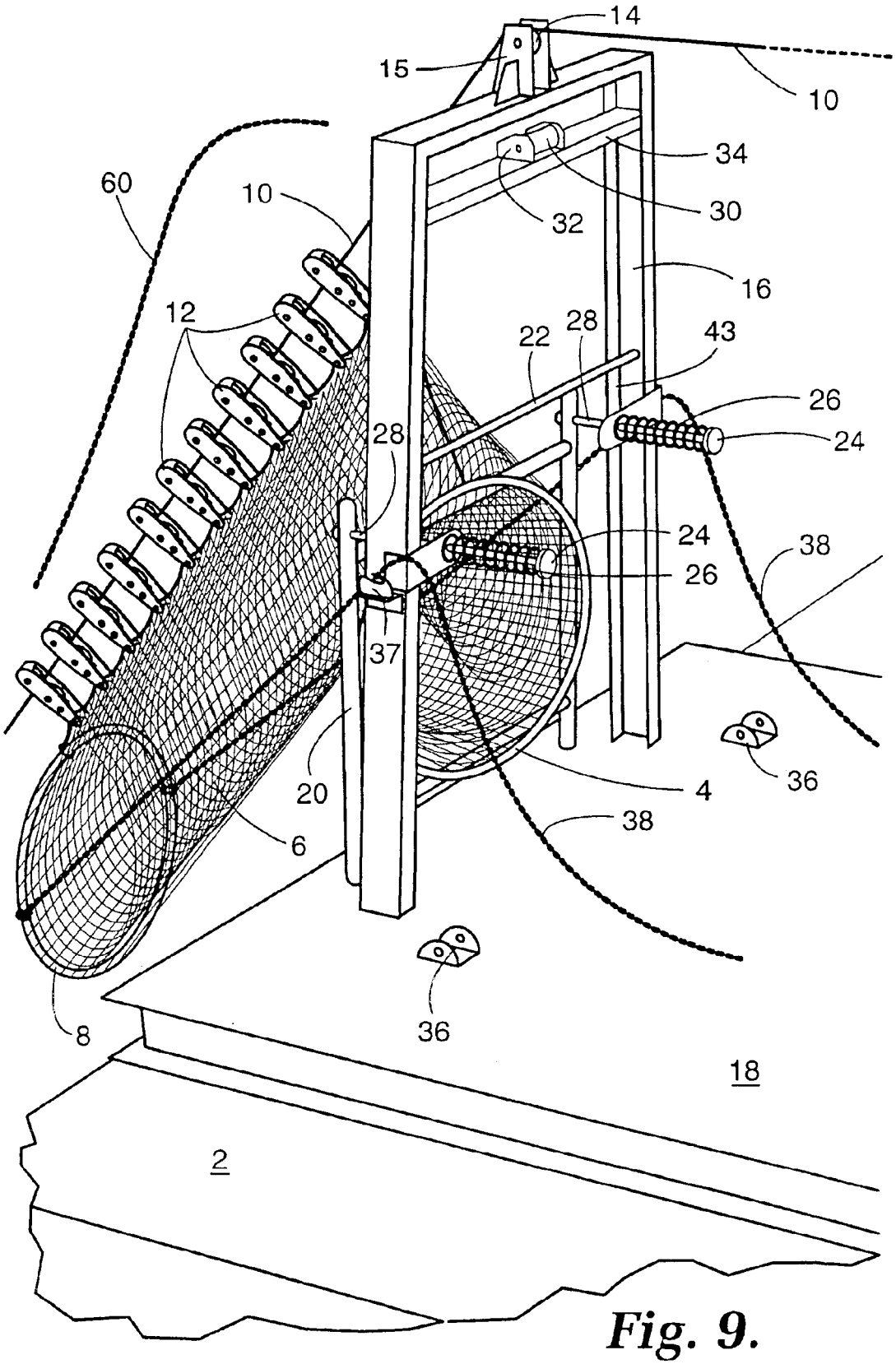
FIG. 9 is a perspective view of the escape apparatus with sleeve and canopy covering removed to illustrate, in detail, the interrelated component structures thereof.

FIG. 9 shows the apparatus of the invention in an exploded perspective view, from a vantage point on the roof of building 2. The canopy 40 and sleeve 64 have been removed for clarity of illustration. The mesh tube 6 is attached at the upper end to entry ring 4 and at the lower, exit end to exit ring 8. Along the length of tube 6 and attached thereto at spaced apart intervals are the plurality of block-and-pulley means 12, all riding upon and guided by cable 10, which extends over fulcrum 14, mounted on bracket 15, and to the building where it is permanently anchored (not shown). All of this is supported by the truncated "A"-frame support structure 16, which has affixed thereto the support frame 20 which anchors the entry ring 4. Just above the entry ring 4 is a grab bar 22 which spans the "A"-frame and is provided to assist users in entering the escape. The shock absorbing springs 26 mounted to frame 16 make the escape apparatus, as a whole, less rigid and ease the shock on deployment and on a person entering the escape.

To deploy the escape, a user pulls cords 38 from their respective cleats 37 and the chute rides down cable 10 extending to the ground. The deployed chute thus provides a means of egress from building 2.

To restore the chute apparatus to its stored configuration, if that should become necessary after a deployment, one end of a cord 60 may be affixed to the exit ring 8 and the other end of cord 60 may be inserted through the "A"-frame structure over roller 30 affixed to cross-member 34, and the apparatus pulled back up by winch or manually to the exit level (roof).

Figure 10:
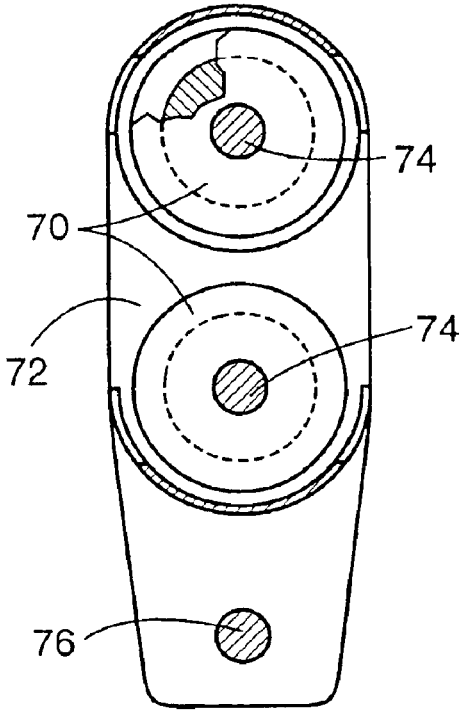
FIG. 10 is a side elevation, partly broken away, of another preferred block-and-pulley assembly used in the apparatus of the invention.
Figure 11:
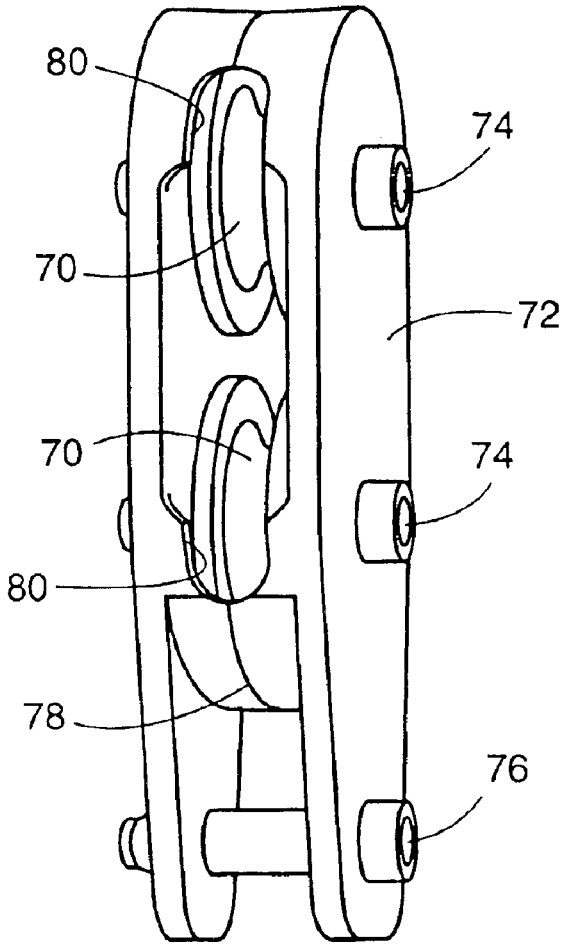
FIG. 11 is a front elevation of the block-and-pulley assembly of FIG. 10.

FIG. 10 shows an alternate, and preferred, block-and-pulley means suitable for use in the invention. Therein the block 72 has dual pulleys 70 mounted vertically on axle pins 74, and has a single connecting pin 76 to be connected in use through the mesh of tube 6. As shown in FIG. 11, the block 72 has grooves 80 machined therein which accommodate the cable 10 in use and help to enhance, sliding thereover and prevent binding, as the pulleys ride on the cable 10. Built into block 72 is the rounded partition 78, which prevents the mesh from contacting the lower pulley 70 and becoming entangled therewith.

By way of illustration and not of limitation, one skilled in the art will be aware of suitable materials of construction for the various components of this invention. For example, the mesh tube 6 is preferably woven from cords of a fire resistant nylon. The "A"-frame is preferably of steel, and cable 10 is preferably of stainless steel. The cleats 37 and the various cords or lines may be those as used in marine applications. The mesh tube preferably has inside diameter sufficiently large so as not to restrict passage of a person escaping therethrough, such that an escaping person can control his rate of descent by pushing outwardly with his feet or by grasping the mesh anywhere inside the tube 6. The mesh tube preferably has an inside diameter in the range of about 3 feet to about 4 feet. The mesh of the tube is preferably square, and preferably has dimensions of one and one-half inches on a side.

As described above, the sleeve 64 is preferably constructed of Nomex® fire resistant fabric, and it extends downwardly along the tube from the entrance, preferably a distance of at least 20 feet and, for high structures, a distance of 60 feet.

The angle formed by cable 10 with the ground is not especially critical, and must be selected according to the circumstances of use, availability of adjacent land, etc. This angle must obviously be less than 90° but may be much smaller. Angles from 30° to 60° may be suitable, and 45° is preferred.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Fire escape apparatus for egress to the ground from a multi-storied building structure from an upper level thereof, including the roof, in combination with said building structure, the apparatus comprising:

an upper, supporting entry ring member detachably anchored to said structure at an exit location thereof, including said roof, said entry ring member having attached to it one end of an elongate mesh tube, the mesh tube being substantially longer than the structure height from which escape is to be effected and being sufficiently long to enable extension downwardly from said exit location to the ground, said mesh tube having a lower, exit-opening support ring member attached thereto at its other end thereof, said structure having permanently attached thereto, adjacent said exit location, one end of a guide wire or cable extending from said structure at a desired angle to the ground, said cable being permanently affixed at its other end to a ground anchor on the ground, said elongate mesh tube having affixed thereto, at spaced-apart intervals along a length of said tube, a plurality of supporting blocks-and-pulleys, said pulleys of said blocks-and-pulleys engaging and riding upon said guide wire or cable, said apparatus including at least one longitudinal reinforcing cord affixed at one end thereof to said entry ring member, intertwining said mesh tube along its length thereof, and being affixed at its other end to said exit-opening, support ring, wherein at least two cords of said mesh tube connect said tube and longitudinal reinforcing cord through each supporting block of said plurality of blocks-and-pulleys at each point of connection with said tube, whereby, when needed, said tube is deployed from said upper level downwardly such that said exit-opening ring member extends to ground level and said entry ring member affords entry therethrough into said tube at said exit location, thereby permitting escape to ground level through said tube by a person entering said tube from said upper level.

2. The apparatus of claim 1 wherein said exit location is the roof of said building structure.

3. The apparatus of claim 1 wherein said exit location is an upper level opening in said building structure, including a window thereof.

4. The apparatus of claim 1 wherein said exit location is an upper level window of said building structure.

5. The apparatus of claim 1 wherein said plurality of blocks-and-pulleys are spaced apart at equal intervals along a length of said guide wire upon deployment of the apparatus.

6. The apparatus of claim 5 wherein said blocks-and-pulleys are spaced apart along the entire length of said guide wire.

7. The apparatus of claim 5 wherein said blocks-and-pulleys are each spaced apart one-from-another a distance within the range of five feet to seven feet.

8. The apparatus of claim 7 wherein said blocks-and-pulleys are spaced apart at approximately six foot intervals.

9. The apparatus of claim 1 wherein said guide wire or cable is constructed of stainless steel.

10. The apparatus of claim 1 wherein said blocks-and-pulleys each comprise a block and dual pulleys.

11. The apparatus of claim 1 wherein said guide wire forms an angle to the ground which is between 30° and 90°.

12. The apparatus of claim 11 wherein said guide wire forms an angle to the ground which is approximately 30°.

13. The apparatus of claim 11 wherein said guide wire forms an angle to the ground which is approximately 45°.

14. The apparatus of claim 11 wherein said guide wire forms an angle to the ground which is approximately 60°.

15. The apparatus of claim 1 including a sleeve covering at least a portion of said tube and extending from said entry ring member downwardly a distance from said entry ring member.

16. The apparatus of claim 15 wherein said sleeve extends a distance of at least twenty feet downwardly from said entry ring member along the length of said tube.

17. The apparatus of claim 16 wherein said sleeve extends a distance of at least sixty feet downwardly from said entry ring member along the length of said tube.

18. The apparatus of claim 15 wherein said sleeve is constructed of Nomex® synthetic fabric.

19. The apparatus of claim 1 including a canopy disposed over the entry ring member and extending downwardly therefrom over said tube along at least the upper portion thereof.

20. The apparatus of claim 19 wherein said canopy is retractably disposed over the upper portion of said tube.

21. The apparatus of claim 19 wherein said canopy is constructed of Kevlar® fabric.

22. The apparatus of claim 1 wherein said mesh tube is constructed of cords intertwined to form a square mesh.

23. The apparatus of claim 1 wherein said reinforcing cord has a tensile strength of at least 9200 psi.

24. The apparatus of claim 1 having mesh openings in said mesh tube which are large enough to permit finger insertion therein but small enough to prevent foot insertion therethrough.

25. The apparatus of claim 22 wherein the square mesh openings in said mesh tube each have a side dimension of about one and one-half inches.

26. The apparatus of claim 1 wherein said tube has inside diameter sufficiently large so as not to restrict passage of a person escaping therethrough, whereby said escaping person can control his rate of descent by pushing outwardly with his feet and/or by grasping the mesh anywhere within the tube.

27. The apparatus of claim 1 wherein said mesh tube has an inside diameter in the range of about 3 feet to about 4 feet.

28. The apparatus of claim 22 wherein said mesh cords are constructed of a fire resistant material.

29. The apparatus of claim 28 wherein said fire resistant material is fire resistant nylon.

30. The apparatus of claim 1 wherein said mesh tube is constructed of fire resistant nylon.

* * * * *